United States Patent [19]

Dorph

[11] Patent Number: 4,614,579

[45] Date of Patent: Sep. 30, 1986

[54] HYDRAULICALLY OPERATED DIFFERENT DENSITY PARTICLE SORTING PROCESS

[76] Inventor: Thor Dorph, 119 South Blvd., San Mateo, Calif. 94402

[21] Appl. No.: 547,237

[22] Filed: Oct. 31, 1983

[51] Int. Cl.[4] ..... B07B 9/00

[52] U.S. Cl. ..... 209/18; 209/456; 209/458; 209/460; 209/157

[58] Field of Search ..... 209/157, 458, 460, 18, 209/454, 456

[56] References Cited

U.S. PATENT DOCUMENTS

| | | | |
|---|---|---|---|
| 677,537 | 7/1901 | Covel | 209/458 |
| 1,802,836 | 4/1931 | Rowley | 209/458 |
| 2,294,587 | 9/1942 | Vissac | 209/458 |
| 2,631,726 | 3/1953 | Auer | 209/157 |
| 2,946,434 | 7/1960 | Brina | 206/56 |
| 3,240,336 | 3/1966 | Condolios | 209/157 |
| 3,599,791 | 8/1971 | Grenoble | 209/157 |
| 3,662,885 | 5/1972 | Dorph . | |
| 3,739,911 | 6/1973 | Patch | 209/460 |
| 3,945,915 | 3/1976 | Wilson | 209/480 |
| 4,052,303 | 10/1977 | Hultsch et al. | 210/373 |
| 4,275,522 | 6/1981 | Glover | 261/121 M |

FOREIGN PATENT DOCUMENTS

| | | | |
|---|---|---|---|
| 287499 | 8/1928 | United Kingdom | 209/157 |

OTHER PUBLICATIONS

Condolios, "Two Hydraulic Machines for . . . Concentration . . . ", Mineral Processing, pp. 261–277, 1965.

*Primary Examiner*—David L. Lacey

*Assistant Examiner*—Titus B. Ledbetter, Jr.

*Attorney, Agent, or Firm*—Limbach, Limbach & Sutton

[57] ABSTRACT

A process of using an apparatus (10) hydraulically separating a mixture of small size mineral particles (42) according to different mineral densities (61 and 91) consists of an elongated inclined tubular conduit (11) which includes appurtenances and adjustments by which the innately higher midstream velocity and lower, conduit sidwall surface velocity forces of the adjusted upward fluid flow through the inclined conduit (11) are systematized for the processing. In combined operations the mixed feed particles (42), after introduction at intermediate longitudinal location (31) of the inclined conduit (11), drop rapidly out of fluid flow suspension and are processed while continuously maintained in a predominantly precipitated condition. During processing, the precipitated particles (42) are formed into a more or less continuous layer of two superincumbent strata which move or tend to move relatively in opposite longitudinal directions throughout the length of the inclined conduit (11). Within the two opposite moving strata, the heavy mineral particles (91) spontaneously segregate into the downward moving underlying stratum, and after processing by lower fluid flow velocity forces are discharged from the lower conduit terminus (17) as concentrate particles (91). Meanwhile, the light mineral particles (61) spontaneously segregrate into the upward moving, overlying particle stratum, and after processing by higher midstream fluid flow velocity forces, are discharged from the upper conduit terminus (13) as tailings particles (61).

2 Claims, 3 Drawing Figures

HYDRAULICALLY OPERATED DIFFERENT DENSITY PARTICLE SORTING PROCESS

BACKGROUND OF THE INVENTION

1. Field of the Invention

This invention relates to a hydraulically operated gravitational process and apparatus and method which recovers a concentrated product containing dense or heavy mineral particles in smaller sizes than obtainable with similar equipment of the prior art. More particularly, this invention relates to such an apparatus and process in which boundary wall or surface effects on fluid flow are utilized to separate relatively light mineral particles from relatively dense or heavy mineral particles, such as in mineral processing.

2. Description of the Prior Art

It is known in the prior art to use an inclined conduit or tube to separate relatively heavy mineral particles from relatively light mineral particles using fluid flow through the inclined conduit or tube. Such apparatus and its operation is taught, for example, in U.S. Pat. Nos. 2,946,434 and 3,240,336, which are commercially known as the Lavodune and Lavoflux, respectively.

The apparatus described in these two patents includes an elongated inclined tubular or pipe-like conduit through which a fluid or water flows in the upward direction. The feed mixture of different density particles is initially introduced into the fluid flow at an intermediate longitudinal location of the inclined conduit. During the subsequent processing, the denser or heavy mineral particles resultantly move in downward direction, in counter direction to the fluid flow, and discharge as concentrates from a lower location of the inclined conduit. Meanwhile, the less dense or light mineral particles resultantly move in the upward direction, and along with the fluid flow are discharged as tailings from the upper terminus of the inclined conduit.

The Lavodune processing method is specifically based on a turbulent condition of fluid flow in which the velocity is regulated between the settling rates of the different density particles. With an appropriate incline of the conduit at approximately 50 to 55 degrees, the particles introduced into the fluid flow are more or less strongly agitated according to different particle densities. The Lavodune processing method recovers heavy mineral particles which include a minimum size of nominally 500 microns.

The Lavoflux processing method is specifically based on a laminar condition of fluid flow in which the velocity is regulated between the entrainment velocities of the different density particles. At an appropriate incline of the conduit of approximately 50 to 60 degrees, the introduced particles are more or less retained in fluid flow suspension throughout the entire processing length of the inclined conduit. The Lavoflux processing method recovers heavy mineral particles which include a minimum size of nominally 70 microns.

While these prior art apparatuses have had some significant commmercial application, a substantial portion of mineral processing includes particles of smaller sizes than included within the above operating ranges. Further technical improvement in such processing or apparatus is required to separate smaller particles according to different relative densities

SUMMARY OF THE INVENTION

Accordingly, it is an object of this invention to provide a gravity method of particle concentrating by using fluid flow through an inclined conduit and which method that will recover smaller sizes of heavy mineral particles than is obtainable by prior art concentrators.

Another object of the invention is to provide an apparatus in which the boundary or conduit wall surface effect on fluid flow through a tubular or pipe-like conduit is usefully applied by which the denser or heavy mineral particles are subsequently processed by the lower fluid flow velocity forces along the conduit boundary wall surfaces while the less dense or light mineral particles are subsequently processed by the higher fluid flow velocity forces in the conduit midstream.

An additional object of the invention is to provide such a gravity method particle concentrator in which opposite moving particle strata are formed within which initial and spontaneous sorting causes the heavy and light mineral particles to each separately accumulate in increasing proportions while moving in the opposite strata directions which occurs under the initially indirect and subsequently direct processing effects of the lower and higher fluid flow velocity forces established in the apparatus.

The above mentioned objects may be obtained through use of the novel apparatus and process herein disclosed. In the apparatus of this invention, the principal element consists of an elongated open-ended tubular or pipe-like conduit, including various appurtenances and other interrelated adjustments, that is mounted at an incline. An upward fluid or hydraulic flow at an appropriate velocity through the inclined conduit establishes the continuous processing method by which different density particles are concentrated or sorted according to different density mineral content. The inclined conduit extends in a first direction, and has a bottom surface extending axially along the conduit or tube which is angularly disposed tranversly in a second direction relative to the first direction; by which means an established low-point line is provided along the entire length of the conduit bottom surface. The conduit has a fluid inlet and a fluid outlet; the fluid inlet positioned at an acute angle or slant relative to the first direction. A mixed particle inlet is connected to the conduit between the fluid inlet and the fluid outlet.

In operation, the mixed density particles are introduced into the upward fluid flow system at an intermediate longitudinal location of the inclined conduit; and after the subsequent processing, the denser or heavy mineral particles discharge as concentrate from the lower open-end terminus of the inclined conduit; while the less dense or light mineral particles, along with the fluid flow, discharge as tailings from the upper terminus of the inclined conduit.

The principal condition for processing in the inclined conduit is obtained by regulating the upward flow velocity in conjunction with adjusting the incline of the conduit which allows the initially introduced different density particles to deposit rapidly out of fluid flow suspension and to accumulate upon the conduit bottom surface. By continued processing, the accumulated particles are formed into a continuous precipitated particle layer that is of more or less uneven depth and consists of two superincumbent strata which move in relatively opposite longitudinal directions to each other upon and along the entire bottom surface length of the inclined conduit.

Within the deposited particle layer, a spontaneous and simultaneous sink and float gravity method of particle sorting occurs within the opposite moving strata. Ostensibly, the heavy mineral particles sink and accumulate in the underlying lower particle stratum, while the light mineral particles float and accumulate in the overlying upper particle stratum. As a consequence of the simultaneously occuring sink and float particle sorting and the particle layer stratification, the heavy mineral particles sink into and accumulate in increasing proportions in the underlying lower particle stratum while it moves in the downward direction against the lower fluid flow velocity and agitation forces located along the conduit bottom surface of the inclined conduit. The light mineral particles float and accumulate in increasing proportions in uppermost outspread positions in the overlying upper particle stratum while it moves along in the upward direction of the more closely located higher midstream fluid flow velocity processing forces in the inclined conduit.

The previously mentioned objects, advantages and operation of the invention should be apparent to those practising the art in accordance with the following drawings along with further explanations and descriptions, as follows:

DETAILED DESCRIPTION OF THE INVENTION

Figures 1, 2, 3:
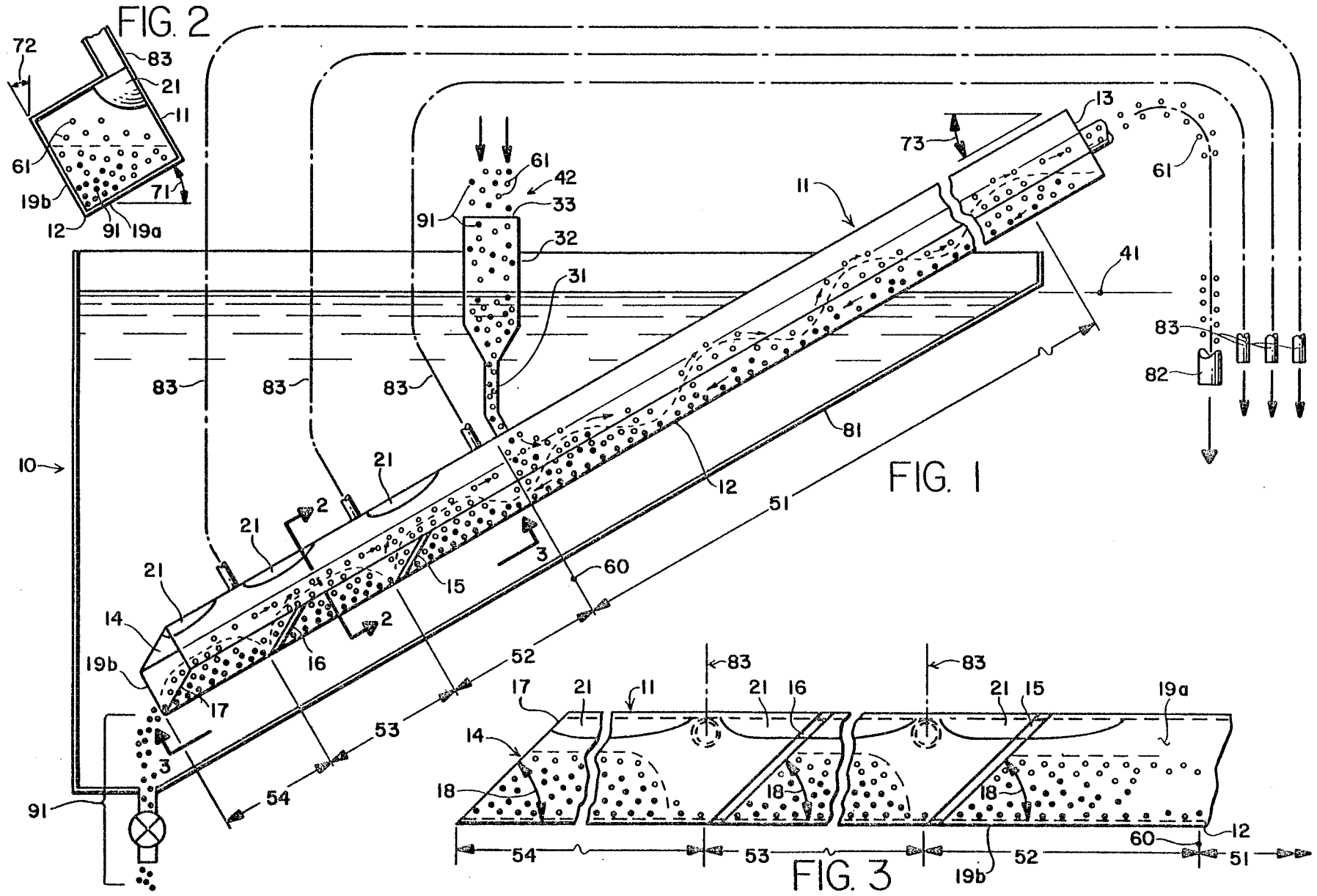
FIG. 1 is a cross section elevation view in schematic form of an apparatus in fully operating arrangement.
FIG. 2 is a cross section of a portion of the apparatus taken along line 2—2 in FIG. 1.
FIG. 3 is a partial bottom view of a portion of the apparatus of FIG. 1 shown along line 3—3 in FIG. 1.

FIG. 1 shows an apparatus 10 in accordance with the invention, in which the principal element is an inclined conduit 11, which is shown in a preferred form of a four-sided tube. However, with appropriate modifications, the conduit 11 may be constructed in other forms and shapes. The inclined conduit 11 is mounted at an appropriate incline angle 73 with a substantial lower end portion submerged to an appropriate depth for operation in fluid, which may be water, as is commonly used for mineral processing. The submergent fluid is contained in a convenient and conventional form of tank 81 in which the fluid is maintained by conventional means at a constant fluid level 41 by a continuous and ample supply of fluid for the operation of the apparatus. In practice, the incline angle 73 of the conduit 11 may vary between approximately 20 to 40 degrees.

For the processing operation, the appropriate upward fluid flow velocity to establish the desired operating conditions for particle processing in the inclined conduit 11 is obtained by regulating the quantity of fluid induced through the apparatus by adjustment of the main fluid discharge siphon tube 82 attached to the upper terminus 13 of the inclined conduit 11.

FIG. 2 shows a nominal cross section of the inclined conduit 11 in the preferred form of a four-sided conduit. By using dry crude feed particles 42 in preliminary testing, a uniform cross-sectional area can be conveniently constructed throughout the length of the inclined conduit 11, and which can be modified to improve particle processing, as described later. For a slurry mixture, an enlargement of the cross-sectional area in the upper portion of the inclined conduit 11 above the crude particle feed inlet 31 may be required to readjust the fluid flow velocity to compensate for any appreciable amount of fluid added with the slurry.

FIG. 3 is an upward partial view of the bottom side of the inclined conduit 11 in which the general operating requirements are indicated for the slanted fluid inlets 15, 16 and 17, particularly in relationship to the side gutter low-point line 12.

In FIG. 1 the apparatus is shown in a completely assembled operating arrangement for processing. The inclined conduit 11 is mounted at an appropriate incline angle 73 and through which an appropriate upward fluid flow velocity is established by the adjustment of the main fluid discharge siphon tube 82 at the upper terminus 13 of the inclined conduit 11. The crude feed particles 41 consist of denser or heavy mineral particles which are represented by the solid dots 91, while the less dense or light mineral particles are represented by the open circular dots 61. For processing, the crude feed particles 42 enter the apparatus above the fluid level 41 through the open top 33 of the partially submerged and vertically positioned particle feed hopper 32. After entry, the mixed density feed particles 42 settle downwards through the fluid within the particle feed hopper 32 and the particle feed connection 31. After introduction through the top side and into the inclined conduit 11, the mineral particles 42 deposit rapidly out of fluid flow suspension and collect into an intermittently formed mound of mixed density particles 42 temporarily retained at the demarcation boundary 60 at the lower end of the first stage 51 in the inclined conduit 11.

In FIG. 1, as the processing continues on the intially deposited mixed density particles 42, the heavy mineral particles 91 sink and accumulate in the continuous underlying lower particle stratum which moves in the downward direction against the inherent lower fluid flow velocity forces along the entire bottom surface length of the inclined conduit 11. Meanwhile, the light mineral particles 61 contained in the initially deposited mixed density particles 42 float and accumulate in the overlying upper particle stratum and are more exposed to the higher midstream fluid flow velocity forces by which, in conjunction with stronger agitation, the light mineral particles 61 are moved in the upward direction in the inclined conduit 11.

FIG. 2 shows a typical cross-sectional configuration of a four-sided inclined conduit 11 in which is shown the particle orientations that occur by the subsequent processing after the crude feed particles 42 initially deposit out of fluid flow suspension at the demarcated boundary 60. The heavy mineral particles 91 are shown accumulated in the downward moving lower particle stratum, while the light mineral particles 61 are shown accumulated in the upward moving overlying upper particle stratum. In FIG. 2, some light mineral particles 61—after previous agitation—are shown suspended in the fluid flow above the deposited particle layer, and while thus suspended move with the fluid flow in the upward direction of the inclined conduit 11. In addition, the tilt angle 71 and the outward slope angle 72 of the conduit bottom **19*a* and the upstanding conduit side 19*b*, respectively, form a converged side gutter with a low-point line 12 that extends throughout the length of the inclined conduit 11. In practice, the angle 71 may vary between 10 to 45 degrees, while the slope angle 72 may be equal to or somewhat less than the tilt angle 71**.

Along the low-point line 12 is where the inherently lowest velocity forces occur in the upward fluid flow and also where the accumulated heavy mineral particles 91 in the underlying lower particle stratum tend to converge in increasing proportions while descending along the inclined conduit bottom surface 19*a*. Meanwhile, the light mineral particles 61 accumulated in the overlying upper particle stratum are positioned closer to the higher midstream fluid flow velocity processing forces by means of which the particles 61 are thus moved in increasing proportions in the upward direction in the inclined conduit 11.

The principal purpose of the converged side gutter low-point line 12 is to provide a channel along which the downward moving heavy mineral particles 91 are guided to merge at and to continue in downward direction while traversing through the lower fluid flow velocity and agitating forces that occur to one side of the diagonally or slant positioned fluid inlets 15, 16 and 17, as shown across the conduit bottom 19*a* of the inclined conduit 11 in FIG. 3.

FIG. 3, in conjunction with FIGS. 1 and 2, shows the side gutter low-point line 12 at a lowered side location of the tilted conduit bottom 19*a*, and is thus extended throughout the length of the inclined conduit 11. All the fluid inlets 15, 16 and 17 are similarly positioned diagonally across the conduit bottom 19*a* with the downward pointing acute angle 18 located at the side gutter low-point line 12. Appropriate slant positioning of the fluid inlets 15, 16 and 17 causes the downward moving heavy mineral particles 91 to divert into closer positioning to the lower fluid flow velocity forces along the side gutter low-point line 12, while entrained light mineral particles 61 are displaced away from the conduit bottom 19*a* and become closer located to the higher midstream fluid flow velocity and agitating forces in the inclined conduit 11.

FIG. 1, in conjunction with FIGS. 2 and 3, shows the inclined conduit 11 appropriately positioned and fully assembled in the tank 81. The apparatus is in processing operation under the previously explained adjustments and conditions by which the introduced particles 42 during subsequent processing are shown distributed and formed into a nominally continuous deposited particle layer which consists of two superincumbent and relatively opposite moving strata. The particle layer is more or less uneven and varies somewhat in depth along its length.

During processing, the two strata move or tend to move superincumbently in relatively opposite longitudinal directions to each other along the entire length of the conduit bottom surface. The strata are continuous, except for slight gaps which occur at the locations of the auxiliary fluid slot inlets 15 and 16 in the inclined conduit 11. During processing, the heavy mineral particles 91 are resultantly collected and converge closer along the low-point line 12 in increasing proportions while moving downwards in the underlying lower particle stratum against the inherently lower fluid flow velocity and agitating forces along the surface of the conduit bottom 19*a*. Meanwhile, the light mineral particles 61 are accumulated in the overlying upper particle stratum and are moved in the upward direction along with the higher velocity and agitating forces of the more closely located midstream fluid flow of the inclined conduit 11.

Two different methods of particle agitation occur in conjunction with the processing and are established in the different longitudinal segments 51, 52, 53 and 54 in the inclined conduit 11. In the order of processing sequence, the first method of particle agitation occurs throughout the length of the first stage 51 into which the crude feed particles 42 are introduced and initially undergo processing. Subsequent processing occurs which includes the second method of particle agitation that is replicated in each consecutive downward abutting second, third, and fourth stage, 52, 53 and 54, respectively.

The second method of particle agitation is established directly at the main fluid inlet 17 and is replicated at the auxiliary fluid slot inlets 15 and 16 by which replication, modification of the particle processing is obtained. The degree of modification of particle processing can be varied by omitting or including additional auxiliary fluid slot inlets, such as 15 or 16, in the inclined conduit 11. Processing modification depends upon the proportional difference of the particle densities, the particle sizes and on the desired quality of the concentrate or tailings products.

In FIGS. 1 and 3, during processing, the first method of particle agitation commences at the demarcation boundary 60 which establishes the lower end boundary of the first stage 51 where an abrupt fluid flow reaction occurs on the particle layer. The abrupt fluid flow reaction causes the overlying upper particle stratum in the first stage 51 to be impeded from moving further downward in the inclined conduit 11 while initially introduced feed particles 42 deposit from the nearby crude particle feed inlet 31 and which while also impeded, collect into a mound of gradually increasing size. When the impeded mound of deposited feed particles 42 increases to a sufficient size, the resultantly restricted fluid flow agitation causes the accumulated particles to undulate upward in the first stage 51. The undulation is caused by the first method of particle agitation which continuously removes particles from the lower end which then redeposit at the upper end of the mound. Once started, the mound continues undulating at a steady upward rate while its size is maintained, and it follows other preceding and similarly formed mounds, which at regular spaced intervals, undulate in lock-step formation in upward direction throughout the length of the first stage 51. The lock-step formation of mounds undulates upwards on top of the simultaneously downward moving underlying lower particle stratum. While undulating upwards, entrained heavy mineral particles 91 sink from the mounds and accumulate in the downward moving, underlying particle stratum from which entrained light mineral particles 61 are displaced and float up into the upwardly moving undulating mounds.

The consequence of the mound undulation by the first method of particle agitation is that as a replacement mound of crude feed particles 42 is formed at the demarcation boundary 60 at the lower end of the first stage 51, the uppermost mound in the lock-step formation of mounds consists of light mineral particles 61 which are discharged along with the fluid flow as tailings from the upper end of the first stage 51 at the upper terminus 13 of the inclined conduit 11. Meanwhile, the separation process is completed in the first stage 51 when the heavy mineral particles 91 collected from the upward undulating mounds and which are accumulated in the underlying lower particle stratum descend throughout the first stage 51, and without interruption pass downwards underneath the abrupt fluid flow reaction at the demarcation boundary 60 into the next abutting second stage 51. In the second stage 51, the particles reform into a stratified particle layer in which subsequent reprocessing occurs in which the second method of particle agitation is included.

The interacting second method of particle agitation processing occurs in replication by the inflow fluid at each succeeding downwardly located auxilliary fluid slot inlet 15 and 16 and at the main fluid inlet 17 at the fixed open-end terminus 14 of the inclined conduit 11. The prototype agitation is established directly at the fixed opening of the main fluid inlet 17, which is then replicated by appropriately adjusting the size of the openings of the auxiliary fluid slot inlets 15 and 16 which are all similarly positioned diagonally across the conduit bottom 19*a*. Also, the fluid inlets 15, 16 and 17 are located separately at the lower ends of the second, third and fourth stages 52, 53 and 54, respectively, the lengths of which are functionally determined by the nature of the inlet influx fluid.

The second method of particle agitation acts upon the deposited and downward moving layer particles which merge with the influx fluid directly at the inlet openings. The resultant agitation more or less vigorously propels the descending layer particles perpendicularly upwards from the conduit bottom 19*a*. The heavy mineral particles 91 are converged closer along the low-point line 12 where correspondingly less vigorous agitation at the fluid inlet only slightly deflects and impinges the heavy mineral particles 91 upon the appropriately outward slope 72 of the upstanding conduit side wall 19*b* where inherently lower fluid flow velocity forces allow the impinged heavy mineral particles 91 to cascade in downward direction past the location of the inlet. After passing the fluid inlet the heavy mineral particles 91, along with fewer entrained light mineral particles 61, either reform into a stratified particle layer in the next downward abutting stage for similar reprocessing, or are discharged as final concentrates from the main fluid inlet 17 at the lower terminus 14 of the inclined conduit 11, and settle to the bottom of the tank 81 for convenient removal. Meanwhile, during the agitation at the fluid inlet, the light mineral particles 61 have been previously displaced by the heavy mineral particles 91 into the more outspread overlying upper particle stratum and are consequently subjected to stronger agitation at the coincidingly located inlet and conduit midstreams which, in combination, results in the more vigorously agitated light mineral particles 61 to be transported further upwards and directly into the previous abutting stage for reprocessing in the conduit system.

In FIGS. 1 and 3 the approximately similar lengths of the second, third and fourth stages 52, 53 and 54, respectively, are determined by a downstream effect of the fluid flow through an inlet. During particle processing, the inlet fluid flow will normally cause an abrupt fluid flow reaction on the deposited particle layer at a nominal downstream distance from the fluid inlet. The adjustment of the auxilliary fluid slot inlets 15 and 16 to replicate the particle agitation also results in an equivalent downstream distance at which the abrupt fluid flow reaction would occur for each fluid inlet. The effective downstream fluid flow reaction establishes the length of the second stage 52 by functionally establishing the location of the demarcation boundary 60. However, the third and fourth stages 53 and 54, respectively, are slightly shortened so that each downstream located fluid inlet nullifies the abrupt fluid flow reaction effect of each upstream fluid inlet. The nullification thus accomplished eliminates an interference that would occur with the particle processing, while allowing for maximum travel distance during which sink and float particle sorting occurs within the deposited particle layer that is reformed between the fluid inlets.

Improved particle processing can be obtained by an incremental increase of the fluid flow velocity forces in the upstream direction of each successively downward second, third and fourth stages 52, 53 and 54, respectively, in the inclined conduit 11. Instead of an incremental decrease of the conduit cross-sectional area to establish such increased fluid flow velocity forces, the fluid flow restriction baffles 21 and the auxiliary fluid flow discharge siphon tubes 83 are provided, as shown and located in FIGS. 1, 2 and 3.

The restriction baffles 21 cause locally increased fluid flow velocity forces, and are positioned opposite the conduit low-point line 12 and at lateral locations to the fluid inlets 15, 16 and 17, which is most effective for improved processing by a slight increase of the agitation forces by each successive second method of particle agitation.

The fluid discharge from the auxiliary siphon tubes 83, in effect, result in higher fluid flow velocity forces in the upstream stage portions in the inclined conduit 11. For this purpose each auxiliary fluid discharge siphon tube 83 is connected at the uppermost location of the second, third and fourth stage 52, 53 and 54, respectively. To entrain the least amount of agitated particles, the siphon tubes 83 are positioned opposite the conduit low-point line 12, as shown in FIG. 2.

In preliminary experiments with an apparatus constructed in accordance with the previous general description and accompanying drawing, several tests were conducted in which a siliceous crude feed sand was processed which contained 4 to 5% of mixed spinels of 3.5 to 4.5 specific gravity and in which the particles were from 400 to 5 microns in size. The resulting concentrate contained 50 to 55% spinel and the tailings contained 2% of residual spinel. The spinel recovery rates varied from 40 to 50%. For operation, one kilogram of crude feed particles required 20 liters of water at a hydraulic head of approximately 15 centimeters.

A principal operating advantage of the apparatus is that a wide latitude of the particle feed rate from zero to maximum can be tolerated and that great proportions of undersize, including slime size particles, do not appreciably affect the processing operation of the apparatus.

It should be readily apparent to those skilled in the art that a novel apparatus and process capable of achieving the stated objects of the invention has been provided. The processing in the apparatus is premised on the characteristic of boundary effects on fluid flow in which relatively higher velocity forces are generated in the conduit midstream, while relatively lower velocity forces are generated at and along the conduit boundary or wall surfaces. After introduction, the feed particles drop rapidly out of fluid flow suspension and then are collected into a continuously extended and stratified layer of predominantly precipitated particles. During operation, initial processing occurs indirectly by the fluid flow which, by a sink and float gravity method of sorting, causes the different density particles to spontaneously displace each other into separate stratified locations within the precipitated particle layer. Then direct action by the fluid flow system occurs during subsequent processing upon the initially displaced and stratified different density particles. The heavy mineral particles are initially displaced into underlying lower stratum locations where lower fluid flow velocity forces during subsequent processing allows the heavy mineral particles to continue descending along the conduit bottom surface. Meanwhile, the light mineral particles, initially displaced into uppermost and more outspread overlying stratum positions, are moved during subsequent processing by and along with the more closely located higher midstream fluid flow velocity forces in the upward direction in the inclined conduit. With an appropriate fluid flow velocity in conjunction with a conduit incline angle of approximately 20 to 40 degrees, the introduced and precipitated particles will form into two strata which will move or tend to move in opposite longitudinal directions upon and along the entire length of the conduit bottom surface. This processing recovers heavy mineral particles of nominally somewhat less than 20 microns.

It should further be apparent to those skilled in the art that various modifications in form and details of the invention as shown and described may be made within the scope and intent of the claims as appended hereto.

What is claimed is:

1. A method of particle sorting in a hydraulically operated apparatus, said apparatus comprising;

an elongated tubular conduit inclined upward in a direction along its longitudinal axis;

a main lower fluid inlet connected to a lower part of the conduit;

a main upper fluid outlet connected to an upper part of the conduit;

a mixed particle feed inlet, connected to the tubular conduit at an intermediate longitudinal location between the main lower fluid inlet and main upper fluid outlet; and, a side-gutter low point line, extending axially along the bottom of the inclined conduit, and that is formed by a first flat upward sloped upstanding conduit side-wall that forms vertexes, along the bottom of the conduit, with a second flat conduit side-wall surface which is tilted downwards at an angle in a second direction that is transversely disposed relative to the inclined direction of the conduit;

said method comprising the stpes of:

(a) providing an adjusted upward fluid flow through the inclined conduit which establishes inherently higher midstream fluid flow velocity forces and inherently lower fluid flow velocity forces at and adjacent to the conduit boundary wall surfaces;

(b) introducing a mixture of different small sized different density mineral particles into the inclined conduit through the mixed particle feed inlet;

(c) adjusting the incline of the conduit in conjunction with the upward fluid flow through the conduit to allow all of the mineral particles for processing to drop rapidly out of the fluid flow suspension and to be maintained in a predominantly precipitated condition;

(d) adjusting the incline of the conduit in conjunction with the fluid flow through the conduit to cause the precipitated mineral particles to form two superincumbent strata, which strata move, or tend to move, in opposite longitudinal directions relative to each other, upon and along the entire bottom surface length of the conduit, the overlying stratum particles tending to move upward in the conduit, and the underlying particle stratum tending to move downward and converging into the side-gutter low point line in the inclined conduit;

(e) sorting the mineral particles according to different particle density occurring spontaneously by interaction of particles colliding while tending to move in opposite longitudinal directions within the strata, causing the heavy mineral particles to sink into and to accumulate in increasing proportions in the lowermost locations along the side gutter low-point line in the downward-moving underlying particle stratum, while causing the lighter mineral particles to float and accumulate in increasing proportions in the uppermost and outspread locations in the upward-moving overlying particle stratum;

(f) discharging heavy mineral particles from the lower terminus of the conduit in which the accumulated and converged heavy mineral particles continuously descend against the lower fluid flow velocity forces along the side-gutter low point line, and through which similar forces emanating from the lower main fluid inlet; and (g) discharging the light mineral particles through the upper main fluid outlet at the upper terminus of the conduit after the light mineral particles that have accumulated in the uppermost and more outspread locations in the overlying particle stratum are thereat agitated and moved in the upward direction by the higher midstream fluid flow velocity forces in the inclined conduit.

2. A method of particle sorting in a hydraulically operated apparatus, said apparatus comprising:

an elongated tubular conduit inclined upward in a direction along its longitudinal axis;

a main lower fluid inlet connected to a lower part of the conduit;

a main upper fluid outlet connected to an upper part of the conduit;

a mixed particle feed inlet, connected to the tubular conduit at an intermediate longitudinal location between the main lower fluid inlet and main upper fluid outlet; and, at least one auxiliary fluid slot inlets, located in an intermediate longitudinal location between the main lower fluid inlet and the mixed particle feed inlet; and, a side-gutter low point line, extending axially along the bottom of the inclined conduit, and that is formed by a first flat upward sloped upstanding conduit side-wall that forms vertexes, along the bottom of the conduit with a second flat conduit side-wall surface which is tilted downwards at an angle in a second direction that is transversely disposed relative to the inclined direction of the conduit;

said method comprising the steps of:

(a) providing an adjusted fluid flow through the inclined conduit which establishes inherently higher midstream fluid flow velocity forces and inherently lower fluid flow velocity forces at and adjacent to the conduit boundary wall surfaces;

(b) introducing a mixture of different small sized different density mineral particles into the inclined conduit through the mixed particle feed inlet;

(c) adjusting the incline of the conduit in conjunction with the fluid flow through the conduit to allow all of the mineral particles for processing to drop rapidly out of fluid flow suspension and to be maintained in a predominantly precipitated condition; and (d) adjusting the incline of the conduit in conjunction with the fluid flow through the conduit to cause the precipitated mineral particles to form two superincumbent strata, which strata move, or tend to move, in opposite longitudinal directions relative to each other, upon and along the entire bottom surface length of the conduit, the overlying stratum particles tending to move upward in the conduit and the underlying particle stratum tending to move downward and converging into the side-gutter low point line in the inclined conduit;

(e) sorting the mineral particles according to different particle density by the spontaneous interaction of particles colliding while tending to move in opposite longitudinal directions within the strata, causing the heavy mineral particles to sink into and to accumulate in increasing proportions in the lowermost locations along the side gutter low-point line in the downward-moving underlying particle stratum, while causing the lighter mineral particles to float and accumulate in increasing proportions in the uppermost and outspread locations in the upward-moving overlying particle stratum;

(f) providing particle agitation forces by adjusting the fluid inflow through at least one auxiliary fluid slot inlet to replicate the particle agitation that is established at the main lower fluid inlet so that previously sorted and segregated downward-moving heavy mineral particles continue moving downward and emanate from the lower fluid flow velocity agitating forces at the auxiliary fluid slot inlet and reform into the lower stratum so that the lower stratum contains relatively fewer entrained light mineral particles and so that the lower stratum is subsequently subjected to further reprocessing which includes either another upstream-located auxilary fluid slot inlet or the main lower fluid inlet while previously sorted and segregated light mineral particles moving downwards into the vicinity of the at least one auxiliary fluid slot inlet are more strongly agitated by the higher midstream velocity forces of the inlet flow and are perpendicularly propelled into the higher velocity conduit midstream fluid flow forces which transport the light mineral particles further upward for reprocessing in the inclined conduit;

(g) discharging heavy mineral particles from the lower terminus of the conduit in which the accumulated and converged heavy mineral particles continuously descend against the lower flow velocity forces along the side-gutter low point line, and through which similar forces emanate from the lower main fluid inlet; and (h) discharging the light mineral particles through the upper main fluid outlet at the upper terminus of the conduit after the light mineral particles that have accumulated in the uppermost and more outspread locations in the overlying particle stratum are thereat agitated and moved in the upward direction by the higher midstream fluid flow velocity forces in the inclined conduit.

* * * * *